US005335883A

United States Patent [19]

Mawer

[11] Patent Number: 5,335,883

[45] Date of Patent: Aug. 9, 1994

[54] OVERHEAD DOOR CABLE WINDING DRUM

[75] Inventor: Daniel W. Mawer, Toledo, Ohio

[73] Assignee: Apco Power-Unit Corporation, Toledo, Ohio

[21] Appl. No.: 21,311

[22] Filed: Feb. 23, 1993

[51] Int. Cl.[5] ..... B65M 75/18

[52] U.S. Cl. ..... 242/602.1; 242/903; 242/613.1; 242/587.1

[58] Field of Search ..... 242/115, 116, 117, 118, 242/77, 77.1, 77.3, 125.1, 118.3; 254/374

[56] References Cited

U.S. PATENT DOCUMENTS

| | | | |
|---|---|---|---|
| 1,874,077 | 8/1932 | Anderson | 242/117 |
| 2,630,597 | 3/1953 | Robinson . | |
| 2,708,080 | 5/1955 | LeBus, Sr. | 242/117 |
| 2,732,150 | 1/1956 | LeBus, Sr. | 242/117 |
| 2,855,162 | 10/1958 | Schact, Jr. | 242/117 |
| 3,038,535 | 6/1962 | Stroup et al. . | |
| 3,150,844 | 9/1964 | LeBus, Sr. | 242/117 |
| 3,391,443 | 7/1968 | Le Bus, Sr. | 242/117 |
| 3,391,879 | 7/1968 | Le Bus, Sr. | 242/117 |
| 3,399,846 | 9/1968 | Le Bus, Sr. | 242/117 |
| 3,412,423 | 11/1968 | Binns . | |
| 3,615,065 | 10/1971 | Elliott | 254/374 X |
| 3,635,277 | 1/1972 | Bahnsen . | |
| 3,921,761 | 11/1975 | Votroubek et al. . | |
| 4,071,205 | 1/1978 | Wieschel | 242/117 |
| 4,519,556 | 5/1985 | Timoschuk | 242/117 |
| 4,731,905 | 3/1988 | Milano et al. . | |
| 4,817,927 | 4/1989 | Martin . | |
| 4,930,183 | 6/1990 | Eichenberger . | |
| 5,103,890 | 4/1992 | Cloutier . | |

FOREIGN PATENT DOCUMENTS 1151779 5/1969 United Kingdom .

OTHER PUBLICATIONS

Apco Power Unit Corporation, Innovation 5254 Hi-lift Drum, 1 page, 1982, U.S.A..

*Primary Examiner*—Daniel P. Stodola
*Assistant Examiner*—John P. Darling
*Attorney, Agent, or Firm*—Howard & Howard

[57] ABSTRACT

A drum for winding a cable attached to an overhead door includes a hub having a central aperture for accepting a shaft, a radially extending boss formed on the hub and a threaded aperture extending through the boss for retaining a threaded fastener for releasably attaching the hub to a shaft extending through the central aperture, a web attached in a central portion of the hub, the web extending radially outwardly at an angle of approximately 60° with respect to the longitudinal axis of the hub, and a cable support extending about and being attached to the web, the cable support having a multi-turn generally helical cable winding groove formed in an outer surface thereof. The cable winding groove includes a first portion spaced a first predetermined constant radius from the longitudinal axis of the hub, a second portion extending from the first portion and a third portion extending from the second portion, the third portion being spaced a second predetermined constant radius from the longitudinal axis of the hub, the first radius being larger than the second radius and the second portion being spaced from the longitudinal axis by a variable radius uniformly decreasing from the first radius to the second radius. A cable entry slot is formed adjacent one end of the first groove portion and includes a cavity having a pair of generally parallel side walls extending at an angle of approximately 2° 30′ with respect to a pair of side walls of the groove.

14 Claims, 2 Drawing Sheets

OVERHEAD DOOR CABLE WINDING DRUM

BACKGROUND OF THE INVENTION

The present invention relates generally to an apparatus for raising and lowering overhead doors and, in particular, to an apparatus for winding a lift cable attached to an overhead door.

Torsion spring counterbalance assemblies are commonly utilized to counterbalance the weight of an overhead door such as a garage door. Most residential and commercial overhead garage doors are of the sectional type which are suspended on overhead tracks when the door is in the up position. A typical torsion spring counterbalance assembly includes a shaft which is journalled for rotation in two or more bearing mounts which are generally attached to the wall above the door opening such that the shaft extends generally horizontally parallel with the door_lintel. Cable winding drums are secured on each end of the shaft and each drum is attached to one end of an associated cable which is wound about the drum and has its opposite end secured to the bottom panel or section of the garage door. The shaft extends through the center of a coiled counterbalance torsion spring having one end secured to the shaft by a winding plug and the other end secured to the door lintel by an anchor plug. The spring is pretensioned and releasably attached to the shaft by the winding plug. The pretensioning tends to urge the drums to rotate in the take-up direction. As the door is lowered from its overhead position, its weight is increasingly shifted from the overhead tracks to the cables. This weight is counterbalanced by the torsion spring which is being wound tighter through the cable drums and the shaft.

Typically, the cable winding drums, the winding plug and the anchor plug are formed from metal castings. A weak point in the cable winding drum is the cable entry slot through which one end of the cable passes as it enters the winding groove on the exterior of the drum. The end of the cable is knotted outside the slot to anchor the cable. Thus, as the door is raised from a closed position, the whole weight of the door is transmitted through the cable to the portion of the drum where the cable slot is formed.

SUMMARY OF THE INVENTION

The present invention concerns an apparatus for winding a cable attached to an overhead door. The apparatus is in the form of a cable winding drum including: a generally tubular hub having an outer surface extending between a first end and a second end and having a central aperture formed therein for accepting a shaft, the central aperture being formed concentric with a longitudinal axis of the hub and extending between the first and second ends of the hub; a generally radially extending boss formed on the outer surface of the hub and having a threaded aperture radially extending through the boss to the central aperture for threadably retaining a threaded fastener for attaching the hub to a shaft for co-rotation therewith; a generally planar web having an inner periphery attached to the outer surface of the hub in a central portion of the hub, the web extending radially outwardly to an outer periphery thereof at an angle of approximately 60° with respect to the longitudinal axis of the hub toward the second end of the hub; and an annular peripheral cable support extending about the hub generally concentric with the longitudinal axis of the hub, the cable support having an outer surface extending between a first end and a second end thereof, the cable support being attached to the outer periphery of the web at the second end of the outer surface. The boss includes a generally planar surface extending at an angle of approximately 30° with respect to the longitudinal axis of the hub.

The cable support has a multiturn generally helical cable winding groove formed in the outer surface between the first end and the second end thereof, a generally radially outwardly extending circumferential first flange formed at the first end of the outer surface and a generally axially outwardly extending circumferential second flange formed at the second end of the outer surface. The cable winding groove includes a first portion extending from the cable entry slot and being spaced a first predetermined constant radius from the longitudinal axis of the hub, a second portion extending from the first portion and a third portion extending from the second portion to the first end of the cable support, the third portion being spaced a second predetermined constant radius from the longitudinal axis of the hub, the first predetermined constant radius being larger than the second predetermined constant radius, the second portion of the cable winding groove being spaced from the longitudinal axis of the hub by a variable radius uniformly decreasing from the first determined constant radius to the second predetermined constant radius over a length of the second portion of the cable winding groove. A cable entry slot is formed in the second flange adjacent one end of the groove, the slot including a cavity having a pair of generally parallel side walls extending at an angle of approximately 2° 30′ with respect to a pair of side walls of said groove.

An advantage of the present invention is that the cable entry slot configuration considerably strengthens the drum at that point thereby reducing drum breakage in the field.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
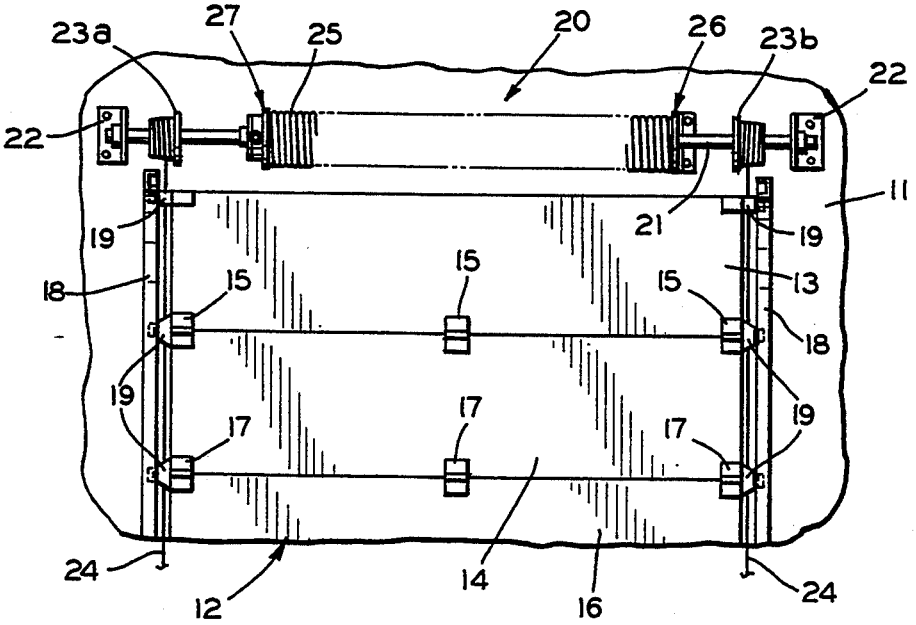
FIG. 1 is a rear elevation fragmentary view of an overhead door mounted in an opening in a building wall and including a cable winding drum in accordance with the present invention.
Figure 2:
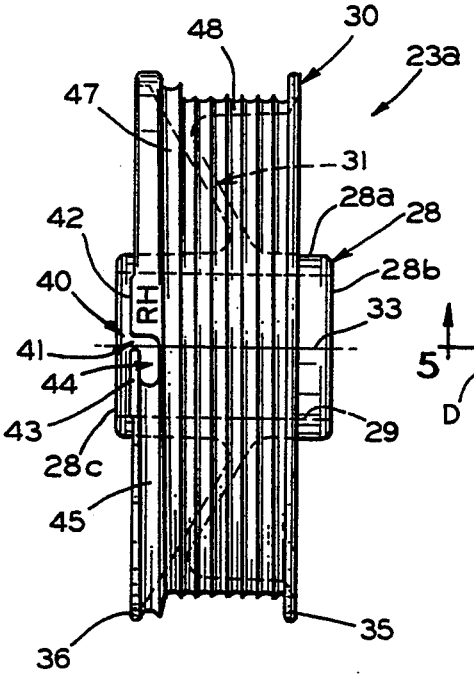
FIG. 2 is an enlarged rear elevation view of the right hand cable winding drum shown in the FIG. 1.
Figure 3:
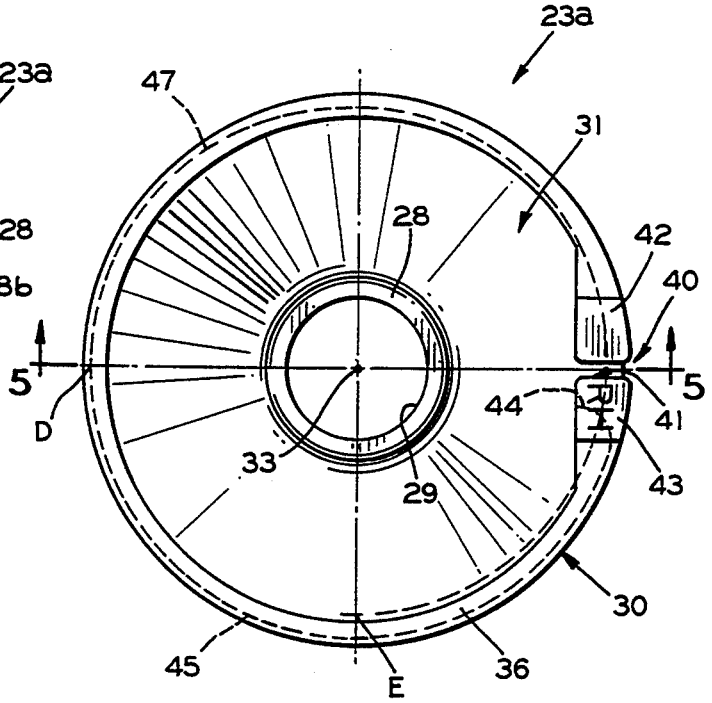
FIG. 3 is a left side elevation view of the drum shown in the FIG. 2.
Figure 4:
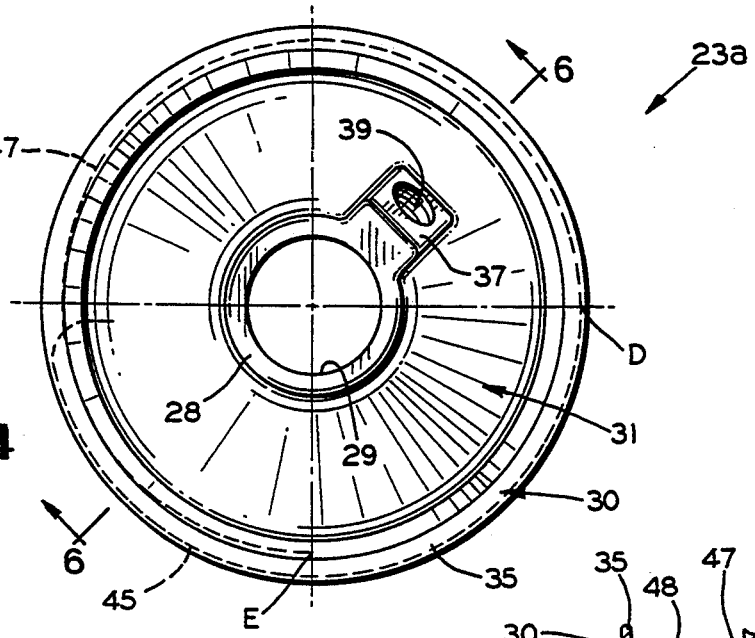
FIG. 4 is a right side elevation view of the drum shown in the FIG. 2.
Figure 5:
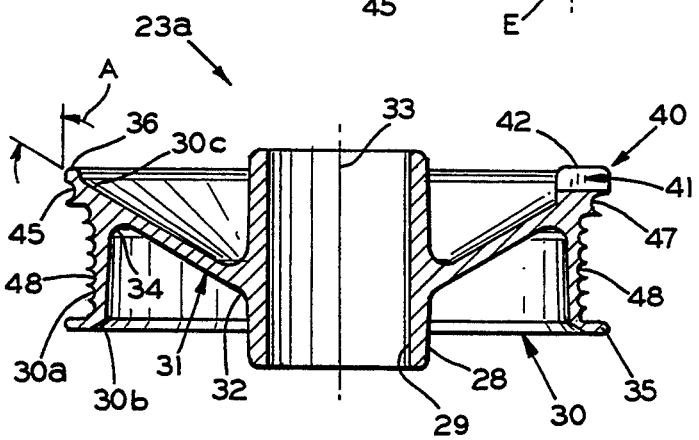
FIG. 5 is a cross-sectional view taken along the line 5—5 in the FIG. 3.
Figure 6:
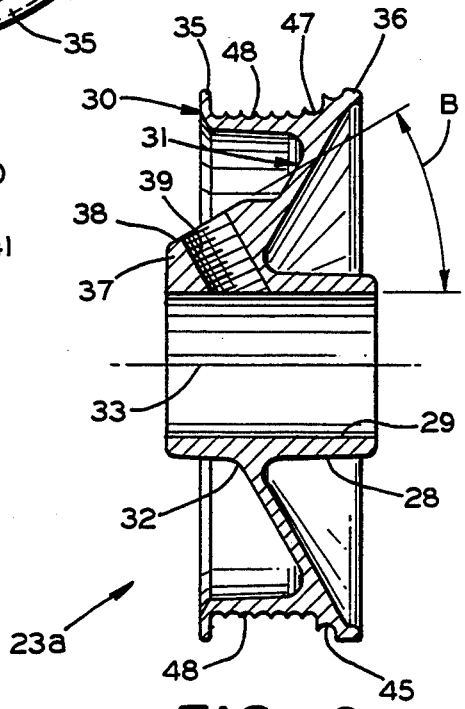
FIG. 6 is a cross-sectional view taken along the line 6—6 in the FIG. 4.
Figure 7:
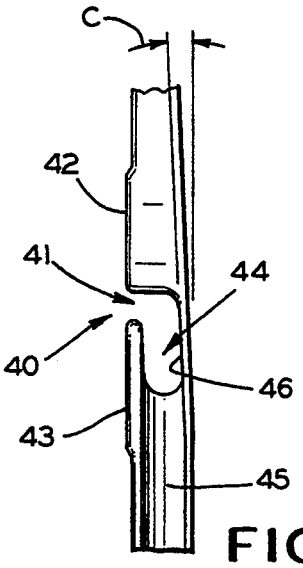
FIG. 7 is an enlarged fragmentary view of the cable slot in the drum shown in the FIG. 3.
Figure 8:
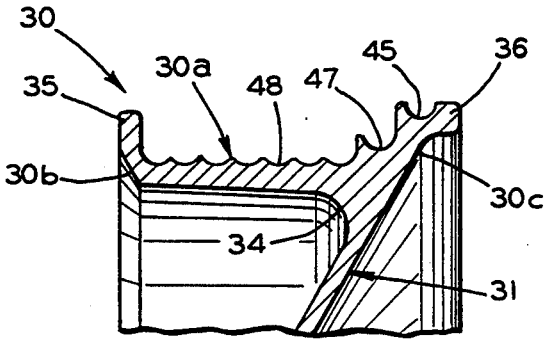
FIG. 8 is an enlarged fragmentary view of the winding groove in the drum shown in the FIG. 6.

There is shown in the FIG. 1 a wall 11 of a building having an opening closed by an overhead door 12. The door 12 is formed of a plurality of generally horizontally extending sections, each of which typically extends from one side of the door opening to the other. A top section 13 is attached to a next lower section 14 by hinges 15. A third section 16 is mounted below the section 14 and is attached thereto by hinges 17. Additional sections can be attached below the section 16 in a similar manner. A pair of tracks 18 are mounted on the wall 11 adjacent the opposite side edges of the overhead door 12. The tracks 18 typically extend from the floor (not shown) of the building vertically upwardly near the top of the door opening and then curve about 90° to extend horizontally towards the interior of the building to provide parallel guide paths for the raising and lowering of the overhead door 12. The opposite side edges of the door 12 are supported for travel along the tracks 18 by a plurality of attached roller assemblies 19.

The task of raising and lowering the overhead door 12 can be made easier by utilizing an overhead door counterbalancing apparatus 20. The counterbalancing apparatus 20 includes a generally horizontally extending shaft 21 having opposite ends rotatably mounted in a pair of brackets 22 attached to the wall 11. Any suitable means can be utilized to prevent the shaft 21 from shifting its position in the direction of its longitudinal axis. A pair of winding drums 23*a* and 23*b* are releasably mounted at opposite ends of the shaft 21 for rotation therewith. Each of the winding drums 23*a* and 23*b* is associated with one of a pair of cables 24. One end of each of the cables is attached to its associated winding drum and wrapped thereabout. The opposite end (not shown) of each of the cables 24 is attached to the bottom of the overhead door 12.

Also mounted coaxially on the shaft 21 is a torsion spring 25 having one end attached to a spring anchor assembly 26 and its opposite end attached to a spring winding assembly 27. The spring anchor assembly 26 is also attached to the wall 11 and the spring winding assembly 27 is releasably attached to the shaft 21 so that the torsion spring 25 can be rotated to apply a predetermined tension to the shaft 21. Although only one counterbalancing apparatus 20 is shown, two or more could be utilized depending on the diameter and length of the torsion spring and the weight of the overhead door 12.

There is shown in the FIGS. 2 through 8, the right hand cable winding drum 23*a*. The drum 23*a* is known as a right hand drum since it is mounted at the right hand end of the shaft 21 as viewed from the outside of the overhead door 12. The left hand drum 23*b* is a mirror image of the right hand drum 23*a*. The drum 23*a* includes a generally tubular hub 28 having a longitudinally extending central aperture 29 formed therein for receiving the shaft 21. The hub 28 has an outer surface 28*a* extending between a first end 28*b* and a second end 28*c* which ends also define the openings of the central aperture 29. The hub 28 is encircled by an annular peripheral cable support 30 connected to the hub by a generally radially extending web 31. As shown in the FIGS. 5 and 6, the web 31 extends from an inner periphery 32 positioned centrally along the outer surface 28*a* of the hub 28 radially outwardly at an angle A of approximately 60° with respect to a longitudinal axis 33 of the drum 23*a*. The web 31 extends outwardly to join the cable support 30 at an outer periphery 34.

The cable support 30 has an outer surface 30*a* which extends between a first end 30*b* and a second end 30*c*. The outer surface 30*a* is bounded at the first end 30*b* by a generally radially outwardly extending flange 35 and at the second end 30*c* by a generally axially outwardly extending boss 37 is formed on the hub 28 in an area of the inner periphery 32 of the web 31. The boss 37 has a generally planar surface 38 extending at an angle B of approximately 30° with respect to the longitudinal axis 33 of the drum 23*a*. A threaded aperture 39 extends from the planar surface 38 to the central aperture 29 formed in the hub 28. The threaded aperture 39 accepts a threaded fastener (not shown) which can be threaded into engagement with the shaft 21 when it is extended through the central aperture 29 in order to prevent movement of the drum 23, either about or along the longitudinal axis 33, as the shaft 21 is rotated about its longitudinal axis to raise and lower the overhead door 12.

Referring to the FIGS. 2, 3, 5 and 7, the flange 36 has a cable entry slot 40 formed therein. The slot 40 has a generally radially extending, outwardly facing entry opening 41 formed between a pair of enlarged pads 42 and 43. The pads 42 and 43 are formed on the flange 36 and extend in a plane generally transverse to the longitudinal axis 33. One of the pads, such as the pad 43, can be marked with a designation "RH" indicating that the drum 23*a* is a right hand drum. The slot 40 extends inwardly from the entry opening 41 generally in a plane including the longitudinal axis 33 and opens into a cavity 44 defining an end of a first portion 45 of a groove formed in the outer surface 30*a* of the cable support 30. Both the entry opening 41 and the cavity 44 extend completely through the flange 36 to permit one end of the cable 24 to be inserted through the entry opening 41 and positioned in the cavity 44 such that the free end of the cable is positioned between the peripheral portion 30 and the hub 28. The free end of the cable can be knotted to prevent it from being pulled through the cavity and a wedge (not shown) such as a nail can be inserted into the cavity 44 with the cable to prevent slippage. As best shown in the FIG. 7, the cavity 44 is elongated in the direction of the first groove portion 45 as defined by a pair of generally parallel side walls 46. As will be described below, the groove represented by the first groove portion 45 extends in a helical path about the longitudinal axis 33. Therefore, the side walls of the groove will extend at an angle to a plane transverse to the longitudinal axis 33. The side walls 46 of the cavity 44 are formed at an angle C of approximately 2° 30" with respect to side walls of the first groove portion 45 to direct the cable 24 into the first groove portion 45.

The first groove portion 45 extends from the cavity 44 as a right hand thread about the exterior surface of the outer periphery 34. As shown in the FIG. 3, the first groove portion 45 extends from the cavity 44 in a clockwise direction approximately one-half revolution to a first point D. Extending from the first point D is a second groove portion 47 which continues for approximately three-quarters of a revolution to a second point E. The first groove portion 45 extends at a constant first radius from the longitudinal axis 33. The second portion 47 spirals inwardly from the first radius at the point D to a second radius at the point E spaced from the longitudinal axis 33. The second groove portion 47 decreases in radius uniformly over its length. From the second point E, a third groove portion 48 extends for approximately six and three-quarter turns to the flange 35. The third groove portion 48 is at the second constant radius.

A pair of the cable drums 23*a* and 23*b* were formed in cast aluminum. When used with a 3/32" diameter steel cable, the radius of the first groove portion 45 and one half the cable diameter produced a high moment arm of 1.9609" while the radius of the third groove portion 48 and one half of the cable diameter produced a flat moment arm of 1.7969". The drums 23*a* and 23*b* could be used in a counterbalance assembly to raise and lower an overhead door having a maximum height of 85" and a maximum weight of 368 pounds.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A cable winding drum for winding a cable attached to an overhead door comprising:

a generally tubular hub having an outer surface extending between a first end and a second end and having a central aperture formed therein for accepting a shaft, said central aperture being formed concentric with a longitudinal axis of said hub and extending between said first and second ends of said hub;

a threaded aperture radially extending through said hub from said outer surface to said central aperture for threadably retaining a threaded fastener for attaching said hub to a shaft for co-rotation therewith;

a generally planar web having an inner periphery attached to said outer surface of said hub, said web extending radially outwardly to an outer periphery thereof at an angle with respect to said longitudinal axis of said hub toward said second end of said hub;

an annular peripheral cable support extending about said hub generally concentric with said longitudinal axis of said hub, said cable support having an outer surface extending between a first end and a second end thereof, said cable support being attached to said outer periphery of said web at said second end of said outer surface, said cable support having a multiturn generally helical cable winding groove formed in said outer surface between said first end and said second end thereof, said cable support having a generally radially outwardly extending circumferential first flange formed at said first end of said outer surface and a generally axially outwardly extending circumferential second flange formed at said second end of said outer surface; and a cable entry slot formed in said second flange adjacent one end of said groove, said slot including an entry opening and a cavity, said entry opening extending generally radially through said second flange, said cavity being connected between said entry opening and an adjacent end of said cable winding groove and having a pair of generally parallel side walls extending at an angle to a pair of side walls of said groove.

2. The winding drum according to claim 1 wherein said web extends at an angle of approximately 60° with respect to said longitudinal axis of said hub.

3. The winding drum according to claim 1 including a generally radially extending boss formed on said outer surface of said hub, said threaded aperture extending through said boss.

4. The winding drum according to claim 3 wherein said boss includes a generally planar surface extending at an angle of approximately 30° with respect to said longitudinal axis of said hub.

5. The winding drum according to claim 1 wherein said inner periphery of said web is attached to said outer surface in a central portion of said hub.

6. The winding drum according to claim 1 wherein said cable winding groove formed in said outer surface includes a first portion extending from said cable entry slot and being spaced a first predetermined constant radius from said longitudinal axis of said hub, a second portion extending from said first portion and a third portion extending from said second portion to said first end of said cable support, said third portion being spaced a second predetermined constant radius from said longitudinal axis of said hub, said first predetermined constant radius being larger than said second predetermined constant radius, said second portion of said cable winding groove being spaced from said longitudinal axis of said hub by a variable radius uniformly decreasing from said first predetermined constant radius to said second predetermined constant radius over a length of said second portion of said cable winding groove.

7. The winding drum according to claim 6 wherein said first portion extends for one half of one revolution, said second portion extends for three quarters of a revolution and said third portion extends for six and three quarters revolutions about said outer surface of said cable support.

8. The winding drum according to claim 1 wherein said side walls of said cavity in said cable entry slot are formed at an angle of approximately 2° 30′ with respect to said side walls of said cable winding groove.

9. A cable winding drum for winding a cable attached to an overhead door comprising:

a generally tubular hub having an outer surface extending between a first end and a second end and having a central aperture formed therein for accepting a shaft, said central aperture being formed concentric with a longitudinal axis of said hub and extending between said first and second ends of said hub;

a generally planar web having an inner periphery attached to said outer surface of said hub in a central portion of said hub, said web extending radially outwardly to an outer periphery thereof at an angle of approximately 60° with respect to said longitudinal axis of said hub toward said second end of said hub;

a generally radially extending boss formed on said outer surface of said hub and having a threaded aperture radially extending through said boss to said central aperture for threadably retaining a threaded fastener for attaching said hub to a shaft for co-rotation therewith;

an annular peripheral cable support extending about said hub generally concentric with said longitudinal axis of said hub, said cable support having an outer surface extending between a first end and a second end thereof, said cable support being attached to said outer periphery of said web at said second end of said outer surface, said cable support having a multiturn generally helical cable winding groove formed in said outer surface between said first end and said second end thereof, said cable support having a generally radially outwardly extending circumferential first flange formed at said first end of said outer surface and a generally axially outwardly extending circumferential second flange formed at said second end of said outer surface; and a cable entry slot formed in said second flange adjacent one end of said groove, said slot including an entry opening and a cavity, said entry opening extending generally radially through said second flange, said cavity being connected between said entry opening and an adjacent end of said cable winding groove and having a pair of generally parallel side walls extending at an angle of approximately 2° 30′ with respect to a pair of side walls of said groove.

10. The winding drum according to claim 9 wherein said cable winding groove formed in said outer surface includes a first portion extending from said cable entry slot and being spaced a first predetermined constant radius from said longitudinal axis of said hub, a second portion extending from said first portion and a third portion extending from said second portion to said first end of said cable support, said third portion being spaced a second predetermined constant radius from said longitudinal axis of said hub, said first predetermined constant radius being larger than said second predetermined constant radius, said second portion of said cable winding groove being spaced from said longitudinal axis of said hub by a variable radius uniformly decreasing from said first predetermined constant radius to said second predetermined constant radius over a length of said second portion of said cable winding groove.

11. The winding drum according to claim 10 wherein said first portion extends for one half of one revolution, said second portion extends for three quarters of a revolution and said third portion extends for six and three quarters revolutions about said outer surface of said cable support.

12. A cable winding drum for winding a cable attached to an overhead door comprising:

a generally tubular hub having an outer surface extending between a first end and a second end and having a central aperture formed therein for accepting a shaft, said central aperture being formed concentric with a longitudinal axis of said hub and extending between said first and second ends of said hub;

means on said hub for releasably retaining said hub on a shaft extending through said central aperture;

a generally planar web having an inner periphery attached to said outer surface of said hub in a central portion of said hub, said web extending radially outwardly to an outer periphery thereof at an angle of approximately 60° with respect to said longitudinal axis of said hub toward said second end of said hub;

an annular peripheral cable support extending about said hub generally concentric with said longitudinal axis of said hub, said cable support having an outer surface extending between a first end and a second end thereof, said cable support being attached to said outer periphery of said web at said second end of said outer surface, said cable support having a multiturn generally helical cable winding groove formed in said outer surface between said first end and said second end thereof, said cable support having a generally radially outwardly extending circumferential first flange formed at said first end of said outer surface and a generally axially outwardly extending circumferential second flange formed at said second end of said outer surface, said cable winding groove including a first portion extending from said second end of said cable support and being spaced a first predetermined constant radius from said longitudinal axis of said hub, a second portion extending from said first portion and a third portion extending from said second portion to said first end of said cable support, said third portion being spaced a second predetermined constant radius from said longitudinal axis of said hub, said first predetermined constant radius being larger than said second predetermined constant radius, said second portion of said cable winding groove being spaced from said longitudinal axis of said hub by a variable radius uniformly decreasing from said first predetermined constant radius to said second predetermined constant radius over a length of said second portion of said cable winding groove;

a pair of pads formed on said second flange extending generally transverse to said longitudinal axis of said hub; and a cable entry slot formed in said second flange adjacent one end of said groove, said slot including an entry opening and a cavity, said entry opening being positioned between said pads, extending generally radially through said second flange, said cavity being connected between said entry opening and an adjacent end of said cable winding groove and having a pair of generally parallel side walls extending at an angle of approximately 2° 30′ with respect to a pair of side walls of said groove.

13. The winding drum according to claim 12 wherein said means for releasably retaining includes a generally radially extending boss formed on said outer surface of said hub and a threaded aperture extending through said boss.

14. The winding drum according to claim 13 wherein said boss includes a generally planar surface extending at an angle of approximately 30° with respect to said longitudinal axis of said hub.

* * * * *